US005918086A

United States Patent [19]

Nakano et al.

[11] Patent Number: 5,918,086

[45] Date of Patent: Jun. 29, 1999

[54] IMAGE FORMATION DEVICE

[75] Inventors: Munenori Nakano, Aichi-ken; Kouji Matsushita, Toyokawa; Tomohiko Teranishi, Toyokawa; Tetsuya Okashita, Toyokawa; Mineo Yamamoto, Toyohashi, all of Japan

[73] Assignee: Minolta Co., Ltd., Osaka, Japan

[21] Appl. No.: 09/045,865

[22] Filed: Mar. 23, 1998

[30] Foreign Application Priority Data

Mar. 25, 1997 [JP] Japan ..... 9-071696

[51] Int. Cl.[6] ..... G03G 15/16

[52] U.S. Cl. ..... 399/66; 399/44; 399/297

[58] Field of Search ..... 399/66, 44, 297; 430/126

[56] References Cited

U.S. PATENT DOCUMENTS

| | | | |
|---|---|---|---|
| 4,728,991 | 3/1988 | Takayama et al. . | |
| 5,200,784 | 4/1993 | Kimura et al. | 399/66 |
| 5,291,253 | 3/1994 | Kumasaka et al. | 399/66 |
| 5,717,980 | 2/1998 | Oka et al. | 399/66 |
| 5,765,074 | 6/1998 | Yasui et al. | 399/66 |

FOREIGN PATENT DOCUMENTS

| | | |
|---|---|---|
| 01308675 | 12/1989 | Japan . |
| 3-110587 | 5/1991 | Japan . |

*Primary Examiner*—Matthew S. Smith

*Attorney, Agent, or Firm*—Burns, Doane, Swecker & Mathis, L.L.P.

[57] ABSTRACT

Image density is detected by a B/W ratio detection integrator 30 via a video signal 11 from a video controller 40 when an image signal is inputted. When a latent image formed on a photosensitive body 7 in accordance with the image signal is transferred to a transfer material 12 by a transfer charging device 8, a transfer current of the transfer charging device 8 is controlled in a timely fashion by a CPU 20 in accordance with the image density detected from this image signal, thus ensuring optimum transfer efficiency. Even when the environment and printing pattern change for each part of a single-page image, this makes it possible to deal accurately with these changes to ensure stable transfer efficiency and good imaging.

26 Claims, 12 Drawing Sheets

| |
|---|
| FIG. 7A |
| FIG. 7B |

IMAGE FORMATION DEVICE

BACKGROUND OF THE INVENTION

1. Technical Field of the Invention

This application is based on application No. 9-71696 filed in Japan, the contents of which is hereby incorporated by reference.

The present invention relates to an image formation device such as a copier, printer or facsimile machine, and particularly to an image formation device comprising an improved transfer control function.

2. Description of the Related Art

In the field of conventional image formation devices, a device which controls transfer output by detecting the number of black pixels in an original has been proposed, for example, as disclosed in U.S. Pat. No. 4,728,991.

However, with the above-described conventional image formation device, transfer output can only be controlled in single original pages-worth of image signal units. Consequently, transfer control cannot always be closely controlled in accordance with image signals and image-producing conditions. For example, transfer efficiency for visible images on every main scan cannot be optimized.

BRIEF SUMMARY OF THE INVENTION

An object of the present invention is to provide an image formation device capable of achieving stable transfer efficiency and good image formation in accordance with partial image signals and image-producing conditions of an original image.

In order to achieve the above object, the image formation device according to one aspect of the present invention comprises: an image carrier; a sensor for detecting image signals that have been inputted; an image formation mechanism for forming a latent image on the image carrier in accordance with the image signals; a developing mechanism for developing the latent image formed on the image carrier into a visible image; a transfer mechanism for transferring the visible image onto an image holding member; and a controller for controlling the transfer mechanism for transferring the visible image onto the image holding member in accordance with results of detection by the sensor of the image signals being representative of the visible image that is being transferred or image producing conditions.

The sensor may be constructed such as to detect a black to white ratio in the image signals, or to detect the image signals per a predetermined period of time.

Preferably, the period of time required for the detection by the sensor is equivalent to a period of time for one scanning action of the image formation device for forming the latent image by successively scanning in a prescribed direction.

The sensor may also detect the image signals that is equivalent to an area where the transfer mechanism opposes to the image carrier.

The transfer mechanism may contact the image holding member within the area where the transfer mechanism opposes to the image carrier.

In accordance with the above-described invention, since transfer efficiency is accurately rationalized in accordance with image signals and image-producing conditions for each part corresponding to transfer, high-quality images can be formed.

Further, by allowing for image producing conditions in addition to the image signals when rationalizing each part corresponding to transfer, even higher-quality images can be formed.

Other and further objects, features and advantages of the invention will appear more fully from the following description.

DETAILED DESCRIPTION OF PREFERRED EMBODIMENTS

Preferred embodiments of the present invention will be hereinafter described in detail referring to the accompanying drawings.

Figure 1:
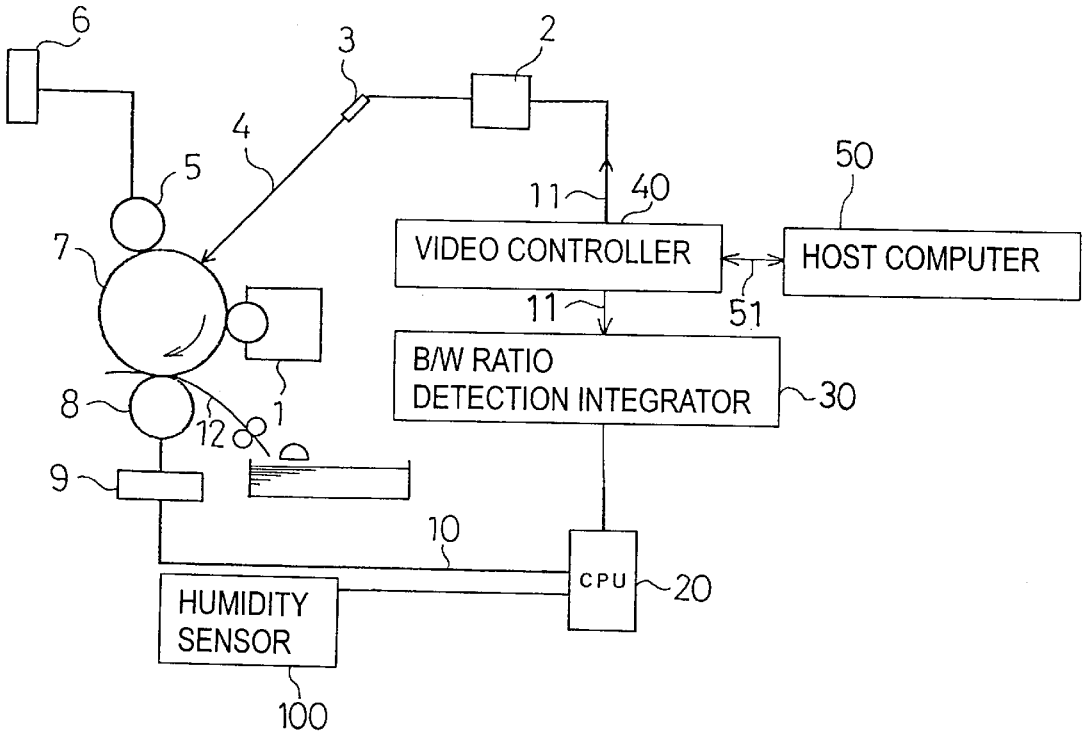
FIG. 1 is a schematic block diagram of a laser printer which is an embodiment typical of the present invention.

FIG. 1 shows an embodiment in which the present invention is applied to a laser printer.

As depicted in the rough configuration shown in FIG. 1, this laser printer comprises a drum-type photosensitive body 7 as an image carrier, which is driven and rotated in the direction indicated by the arrow. A charging device 5 which uniformly charges the surface of the photosensitive body 7, a laser generator 3 which exposes an image on the charged surface of the photosensitive body 7 by irradiating a modulated laser beam 4 in accordance with an image signal, a developing device 1 which produces a visible image by developing a latent image formed on the photosensitive body 7 by image exposure, and a transfer charging device 8 which transfers to a transfer material the visible image resulting from developing the photosensitive body 7 are arranged in sequence around this photosensitive body 7 in the direction of rotation of the photosensitive body 7. The laser generator 3 is connected to a laser driver 2, the charging device 5 is connected to a charging device power source 6, and the transfer charging device 8 is connected to a transfer charging device power source 9, respectively.

The image exposure cited above, as is common with image formation that employs a digital electronic photograph system, is performed by using a polygonal mirror or some other deflection system not shown in the figure to deflect a laser beam 4 irradiated from the laser generator 3, and to main scan that laser beam onto the photosensitive body 7 in the direction of its axis. By repeatedly performing this main scan accompanied by secondary scans resulting from the fact that the photosensitive body 7 is moving in the direction of rotation, a latent image is sequentially formed on the surface of the photosensitive body 7 in accordance with an image signal.

An image signal is, for example, inputted from a host computer 50 to a video controller 40 inside the printer, and, in accordance with this image signal, the video controller 40 outputs a video signal 11 to the laser driver 2 and a B/W ratio detection integrator 30. Here, B/W ratio is the black-to-white ratio in the image signal. The laser driver 2, in accordance with the inputted video signal 11, turns the laser generator 3 ON and OFF, and causes it to generate a modulated laser beam 4 corresponding to the image signal. The B/W ratio detection integrator 30 detects in the video signal 11 a B/W ratio for each prescribed unit that corresponds to a visible image part to be transferred, and, for example, inputs this B/W ratio to an engine-controlling CPU 20, and this CPU 20 outputs a control signal 10 that accords with the detection results in the above-described B/W ratio detection integrator 30. The transfer charging device power source 9, and the voltage applied to the transfer charging device 8 are controlled on the basis of this control signal 10. Although a laser diode is preferred as the laser generator 3, it is not limited to this and other suitable lasers can be used.

The photosensitive body 7 of this embodiment is an organic photosensitive body, and performs what is called inverse developing. That is, the photosensitive body 7 is designed so that when the image signal is ON, it is subjected to the irradiation of the laser beam 4 emitted from the laser generator 3, and developing bias causes developer to adhere to exposed portions where the charge decreases, and when the image signal is OFF, it is not subjected to the irradiation of the laser beam 4, and developer does not adhere to the non-exposed portions where the charge does not decrease. Here, the B/W ratio is the ON/OFF ratio of the image signal. A semiconductive rotating charge brush is used in the charging device 5, and this brush also serves as a device for cleaning residual toner remaining on the photosensitive body 7 following transfer. Therefore, the image formation device of the electronic photograph system of this embodiment is a so-called cleaner-less system. In addition, a fixed brush, blade, film, roller or corona charger can also be used as the charging device 5, and a suitable cleaning device, comprising a blade or brush may also be mounted between the transfer charging device 8 and the charging device 5.

A urethane foam roller is utilized in the transfer charging device 8. Other materials can also be used, such as ethylene propylene diene monomer (EPDM), silicon (Si) rubber, or acrylonitrilebutadiene rubber (NBR). Pulverized fuel ash (PFA) can also be applied as a tubular cover or coating to create a layer on top of these materials. And instead of a roller, a brush, film, belt or corona charger may also be used.

However, as explained below, since the transfer charging device 8 changes the duplication output in a timely manner in accordance with the image, a contact transfer charging device with a narrow transfer area is generally more suitable.

In this embodiment, a visible image on the photosensitive body 7 is contact transferred by the transfer charging device 8 to a transfer material 12, which is an image-holding material. However, the present invention is not limited to this, and non-contact transfer may also be used.

In the image formation process including the charging, exposing, developing, and transferring steps described above, ambient conditions have a substantial influence on the formation of images. Thus, in this embodiment, a sensor or the like is also provided for detecting ambient conditions, and according to the results of detection, image forming conditions are appropriately determined. In the example shown in FIG. 1, a humidity sensor 100 is provided for detecting humidity in the environment. The results of detection are delivered to the CPU 20, which determines optimum conditions for image formation depending on the detected humidity level. The conditions to be determined by the CPU 20 are mainly transfer conditions, but any other conditions in other steps concerning image formation which can be affected by the humidity may also be subjected to such control depending on needs.

Figure 2:
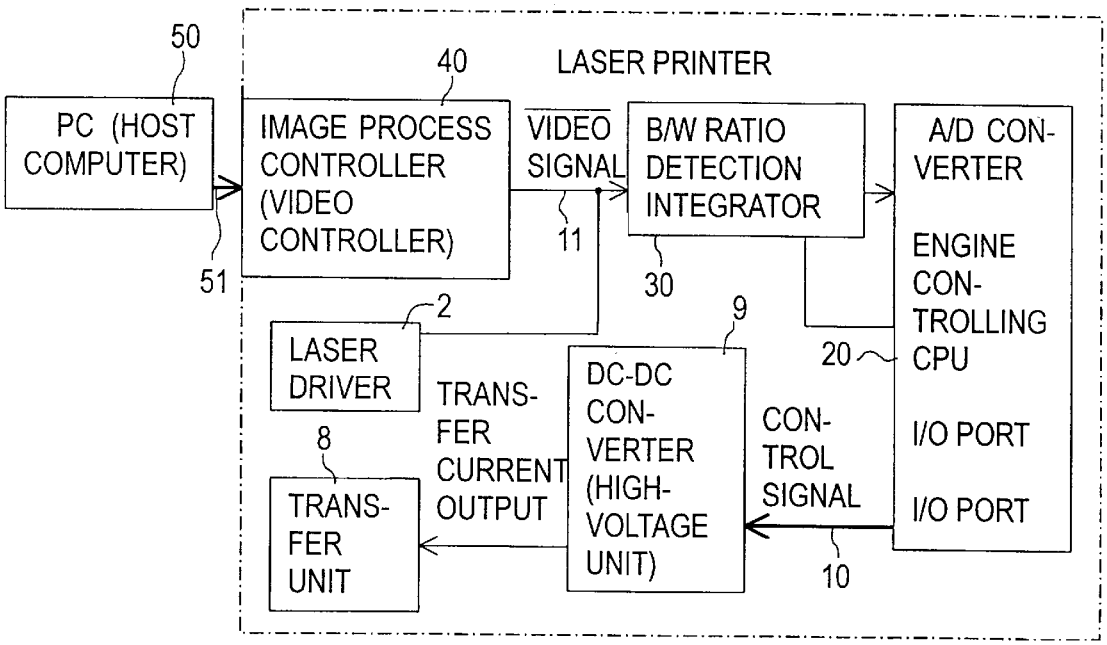
FIG. 2 is a block diagram showing a method for processing image signals in the printer of FIG. 1.

The block diagram in FIG. 2 depicts a specific method for processing an image signal. An image signal outputted by a host computer 50 is transmitted via a cable 51 to a video controller 40 inside a laser printer, where it is converted to a video signal 11. This video signal 11 is outputted to a laser driver 2 and a B/W ratio detection integrator 30. The laser driver 2 turns a laser beam 4 ON and OFF in accordance with this video signal, and forms on a photosensitive body 7 an electrostatic latent image which corresponds to the image signal. Meanwhile, the video signal outputted to the B/W ratio detection integrator 30 is integrated so that its ON time is within a certain fixed time period needed for a visible image formed in accordance with this video signal to be transferred., and this ON time is converted to a voltage value. Then, this voltage value is outputted to an analog-to-digital (A/D) converter in a CPU 20 used to control an engine.

The CPU 20 outputs a control signal 10 in accordance with the voltage value from the B/W ratio detection integrator 30 to the transfer charging device power source 9, which is a high-voltage unit, and controls the transfer current. The transfer current output is changed in multiple stages by this control signal.

It is also possible to integrate laser OFF time instead of laser ON time. Further, image formation mechanism is not limited to combining a charge and an exposure, but rather, a system whereby a direct charge is recorded onto a dielectric material or some other image carrier. In this case, the directly-recorded charge, which is equivalent to laser writing, can be integrated.

Figure 3:
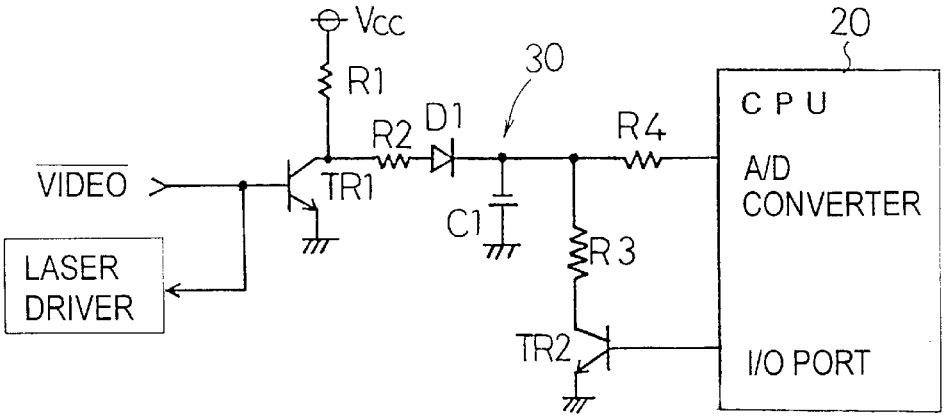
FIG. 3 shows a diagram of a B/W ratio detection integrator of the printer shown in FIG. 1.
Figure 4:
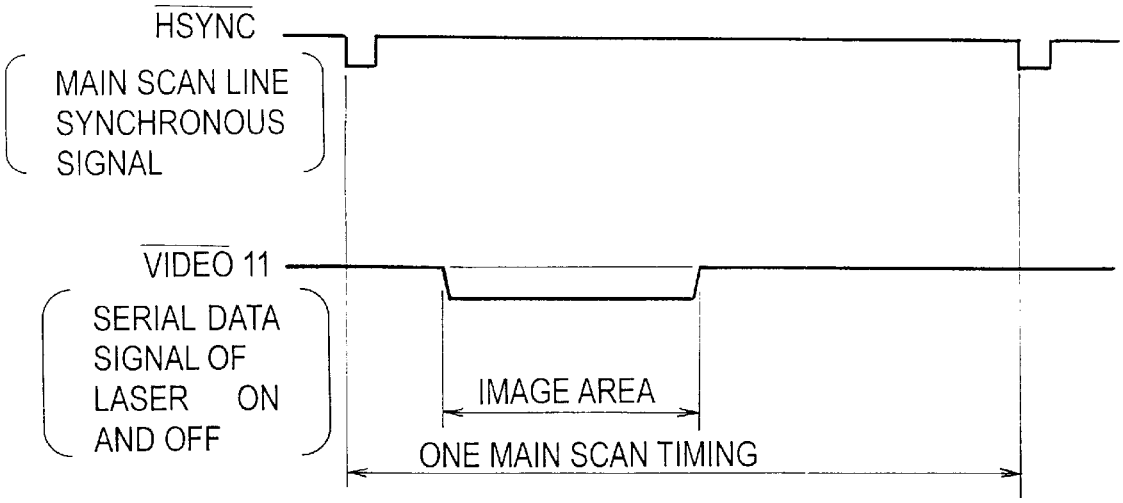
FIG. 4 is a timing chart of one main scan of the laser in the printer shown in FIG. 1.
Figure 5:
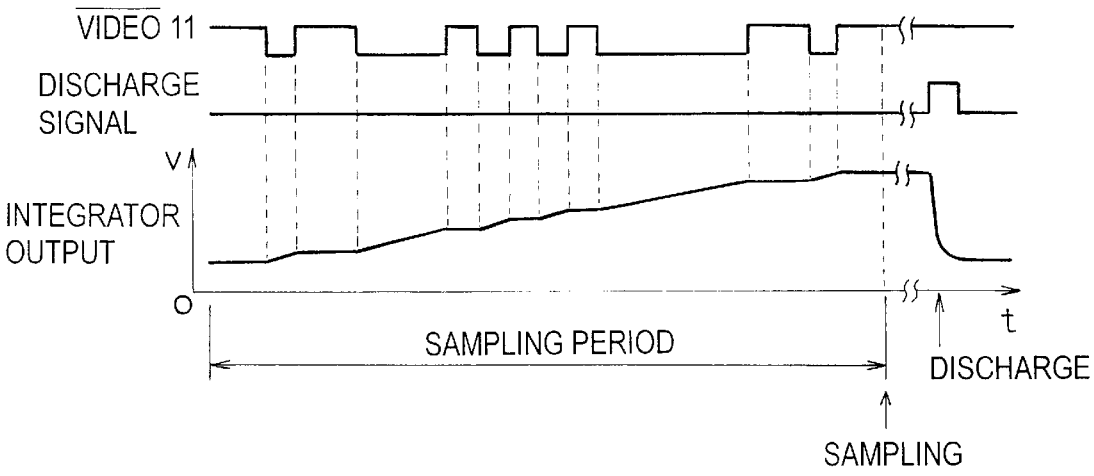
FIG. 5 is an operational diagram of the integrator shown in FIG. 3, which enlarges the image area shown in FIG. 4.

The following description refers to FIGS. 3–5 to explain the operation of the B/W ratio detection integrator 30.

Turning ON and OFF a video signal 11 converted by a video controller 40 turns a transistor TR1 ON and OFF. When TR1 is ON, current flows to C1 via resistors R1, R2, D1 of the B/W ratio detection integrator 30, charging C1. When TR1 is OFF, since current does not flow to C1, C1 is not charged. But since transistor TR2 is OFF at that time, the charge in C1 does not discharge much at all.

After condenser C1 is charged for a certain fixed period of time, the voltage of condenser C1 is read by the A/D converter of the engine-controlling CPU 20, transistor TR2 turns ON and the charge in C1 is discharged via resistor R3. This process is repeated over the entire page.

The timing by which the condenser is charged, as shown in FIG. 4, is set at the timing of one main scan, but this timing can be freely set using a control method. That is, in this embodiment, feedback is provided to transfer mechanism for each main scan. Further, the timing may correspond to the range of a visible image to be transferred via a single transfer process. This makes it possible to avoid making an image signal, which is inclusive of a range that is not involved in a transfer, the basis for controlling in accordance with an image signal the transfer charging device 8 for a visible image to be transferred by the transfer charging device 8. It also enables transfer efficiency to be accurately rationalized in accordance with an image signal for each part corresponding to a transfer, making it possible to achieve good images.

In this sense, the ideal is when the above-cited timing is less than a timing that is equivalent to the discharge of transfer mechanism that is within the effective range for transfer. For example, when controlling transfer using contact transfer mechanism (roller, brush, film, belt), this timing can be less than a timing that is equivalent to a contact nip width and discharge width. That is, transfer can be controlled by an average value derived from the results of multiple main scans.

Signal processing of one main scan of a laser beam 4 as an embodiment of the present invention is explained based on the timing charts depicted in FIGS. 4 and 5. A video signal 11 is turned ON and OFF as shown in FIG. 5 within an image area timing of one main scan timing as shown in FIG. 4, which is between synchronous signals of a main scan print start location of a main scan line synchronous signal (HSYNC signal).

Figure 6:
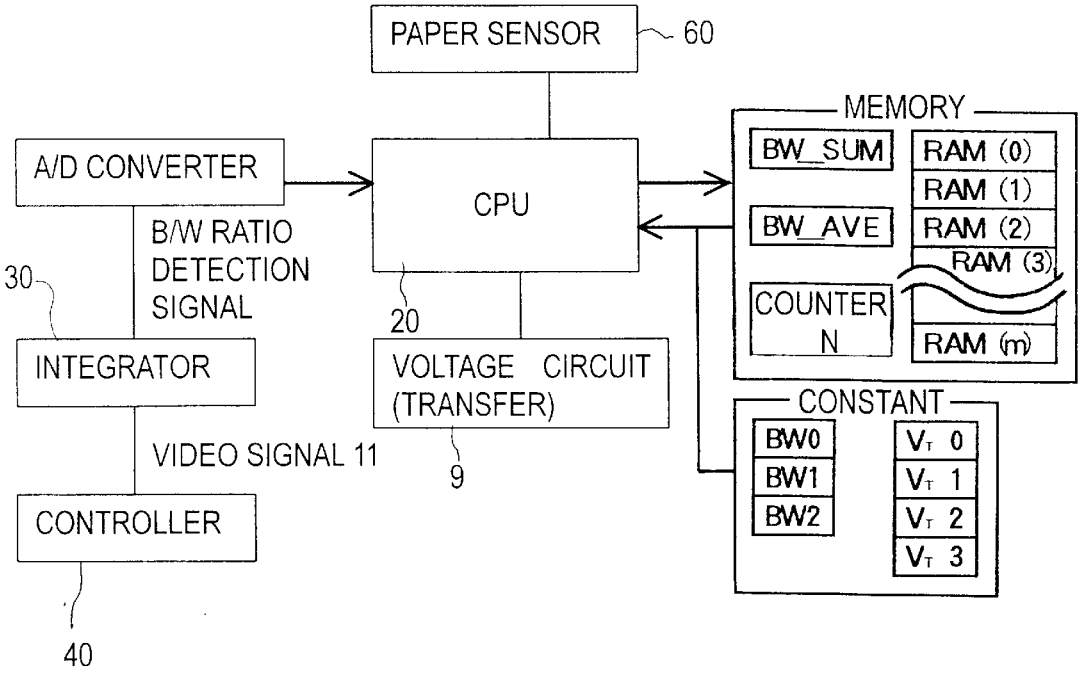
FIG. 6 is a diagram of a B/W ratio transfer feedback system of the printer shown in FIG. 1.
Figures 7, 7A:
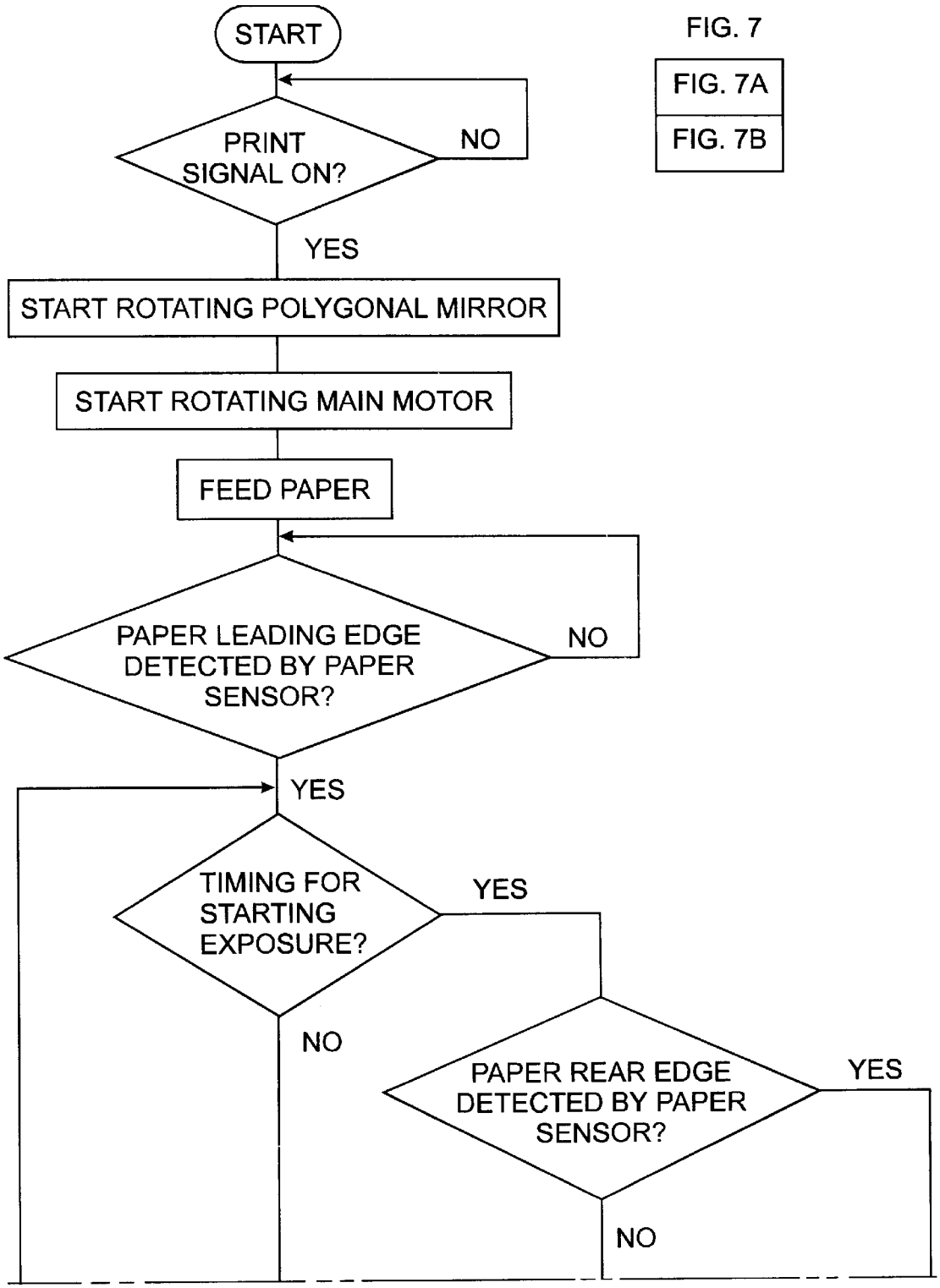
FIGS. 7A and 7B together form a flowchart showing the main routine of the principal operation of a CPU of the printer shown in FIG. 1.
Figure 7B:
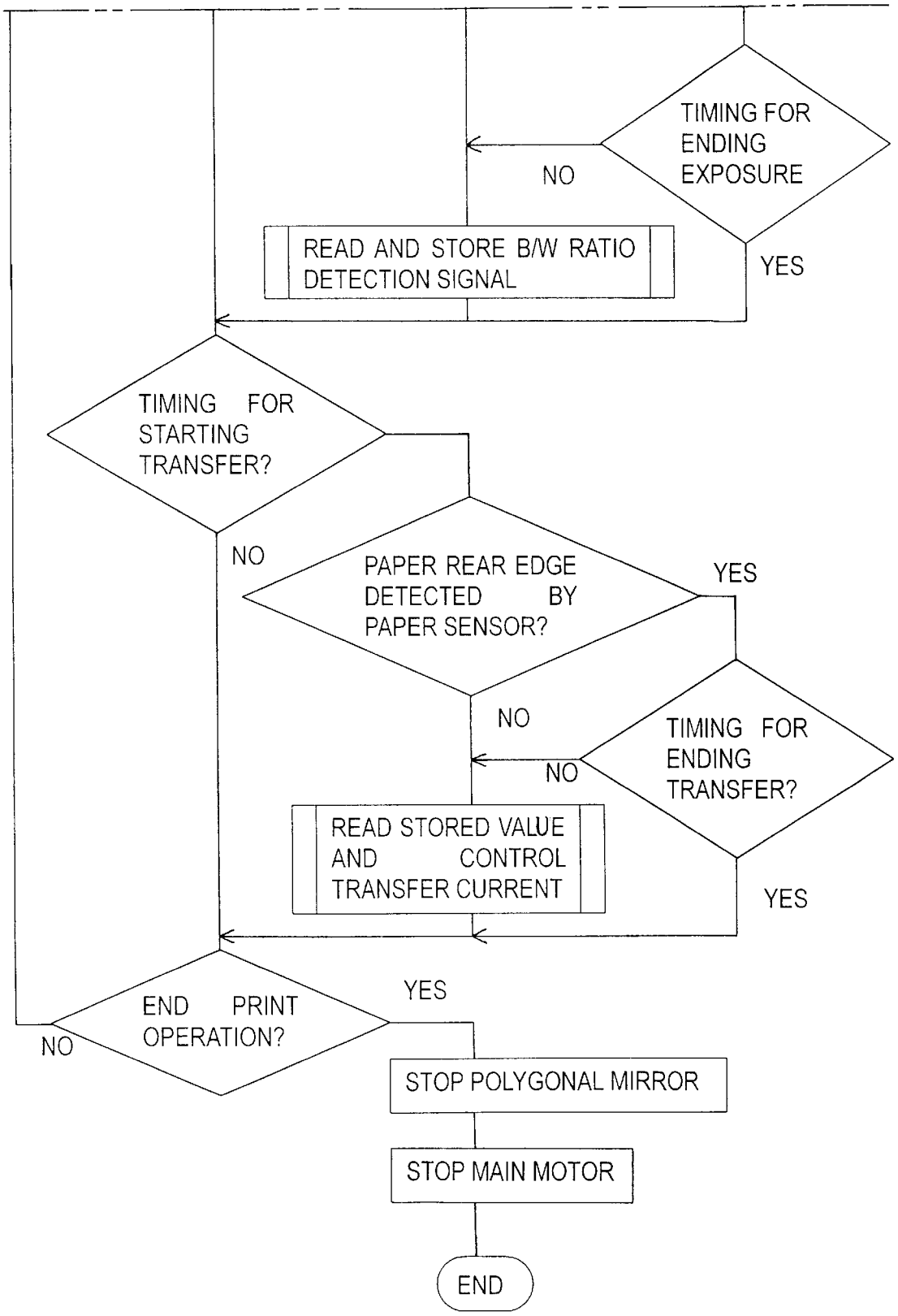
Figure 8A:
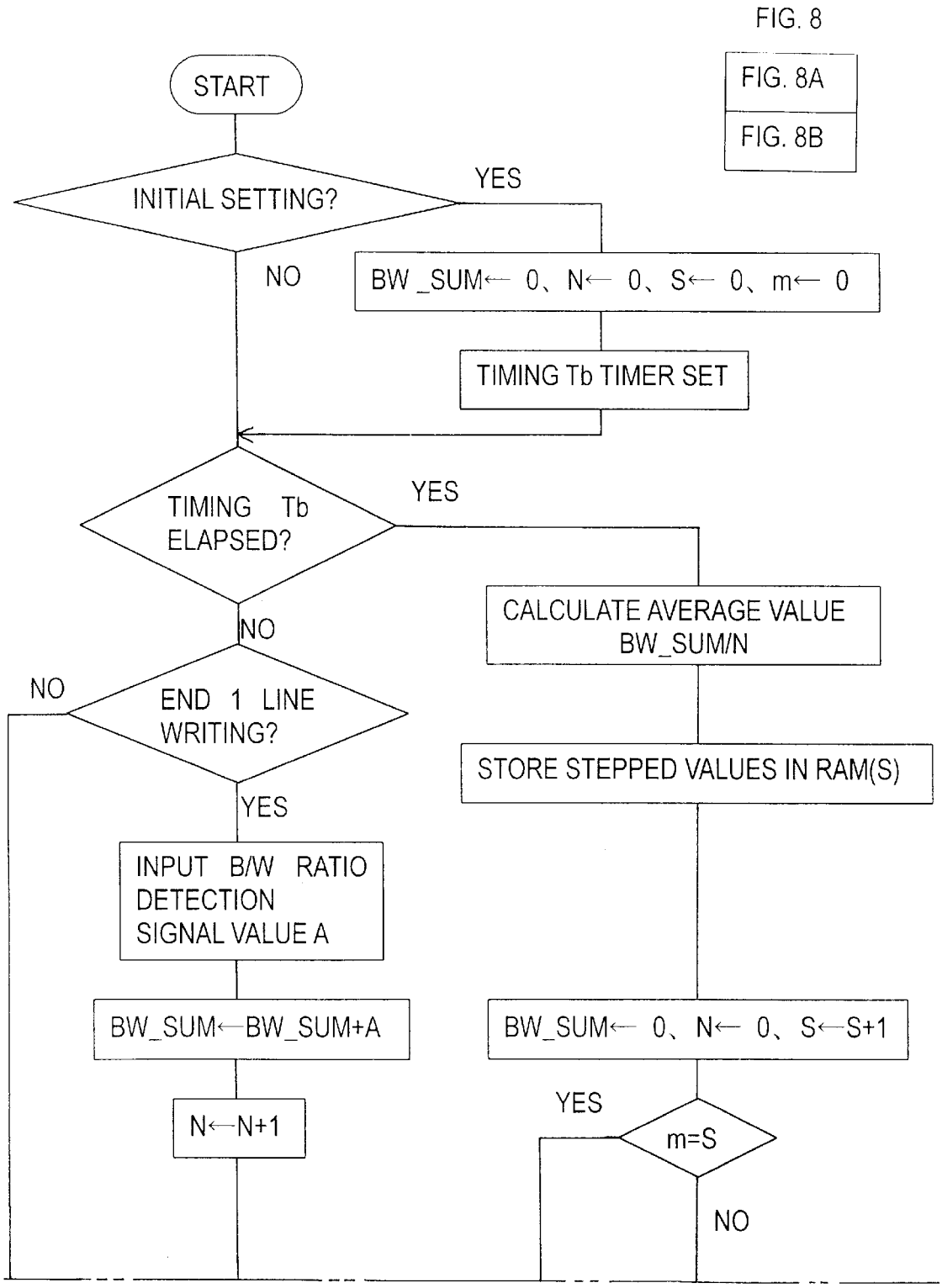
FIGS. 8A and 8B together form a flowchart showing a subroutine, which reads and stores the B/W ratio detection signal cited in FIG. 7.
Figure 8B:
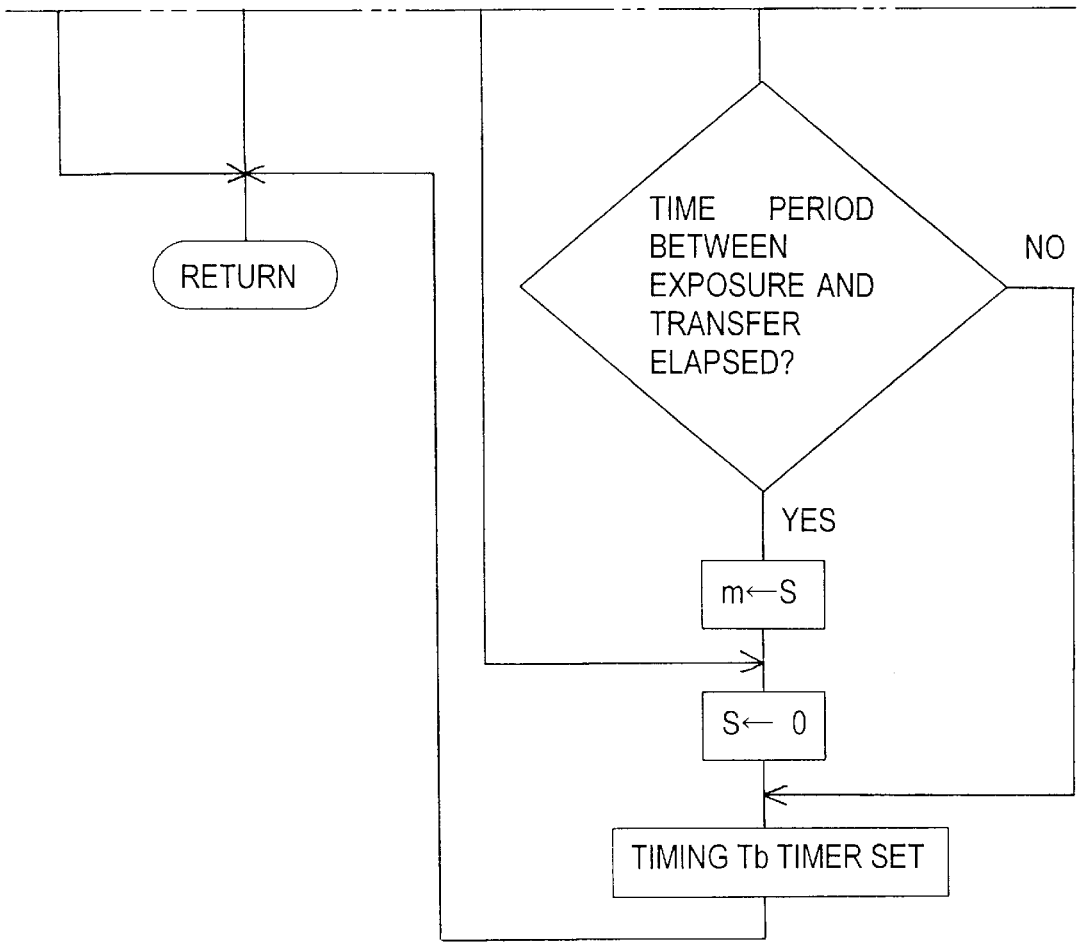
Figure 9:
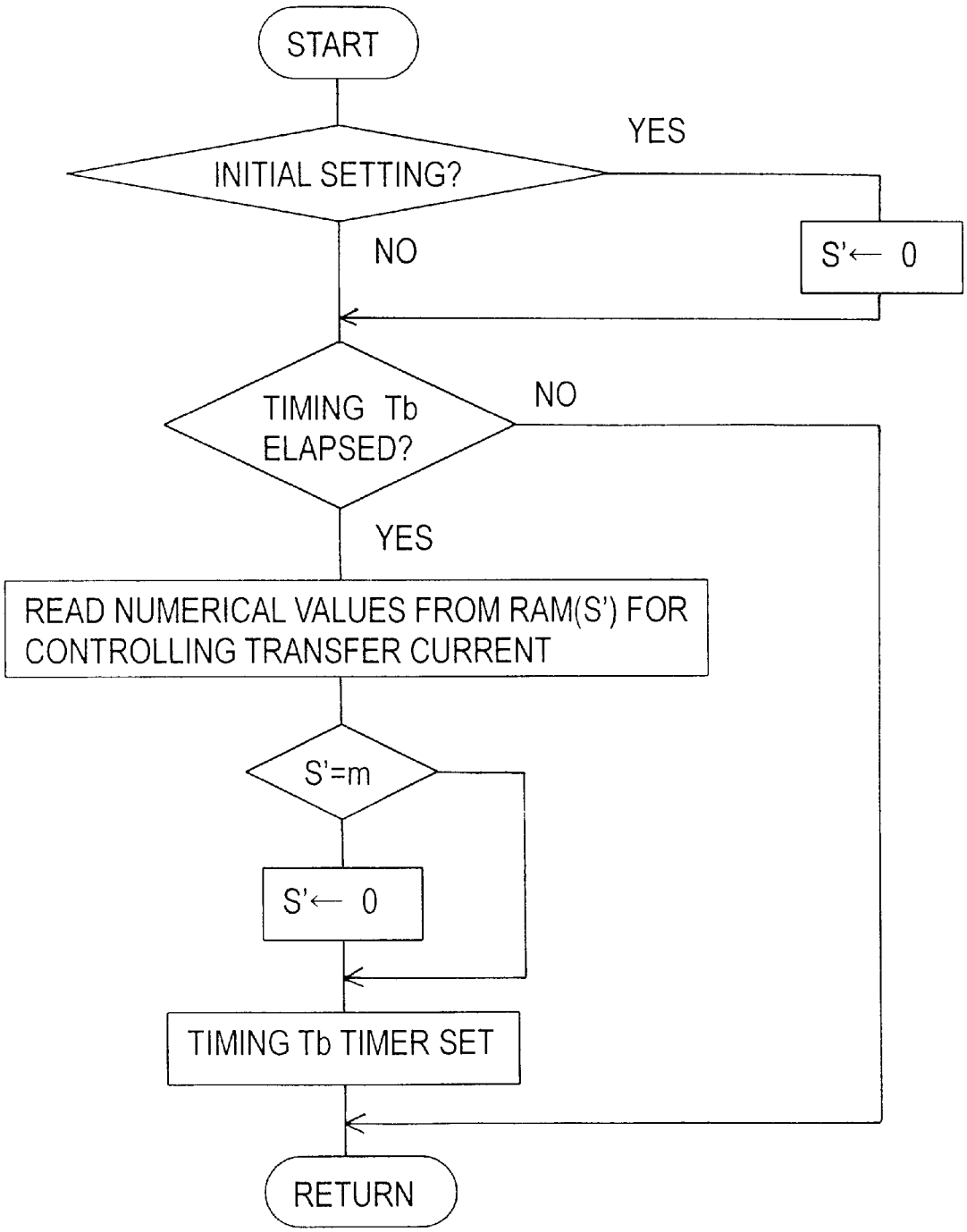
FIG. 9 is a flowchart showing a subroutine, which reads the stored value and controls the transfer current cited in FIG. 7.

A control program is explained referring to the block diagram of FIG. 6 and the flowcharts provided in FIGS. 7 through 9 depicting CPU 20 control. As shown in the flowchart of FIG. 7, when a laser printer receives a print signal, a print operation which lasts from startup to shut down of the polygonal mirror and main motor is performed. And in accordance with the relationship between exposure and transfer timing therebetween, a B/W ratio detection signal is read and stored, and this stored value is read and the transfer current is controlled.

After image data is exposed in accordance with a video signal 11 outputted by a video controller 40 onto a photosensitive body 7 by a laser driver 2 and laser generator 3 in the above-described printing process, a B/W ratio detection integrating signal is sampled for each line as shown in FIG. 8, and output digitized by an A/D converter is added to BW_SUM. Addition is carried out for each line, and a counter N is incremented by +1 for each addition. When a certain sampling timing Tb has elapsed, a value arrived at by dividing BW_SUM by the value of the counter N is stored in BW_AVE. That is, the average value at this point is stored in BW_AVE.

Once an average value has been found, CPU 20 compares this average value with a threshold constant, and determines at what stage the average value is to be applied. For example, when the transfer current is to be set in four stages, three threshold constants exist. CPU 20 re-stores stepped numerical values 0, 1, 2, 3 in BW_AVE. Next, CPU 20 performs processing that shifts the stepped numerical values in BW_AVE to RAM (0). In this way, numerical values that correspond to the period Tb are stored in RAM (0)–RAM (m) at points extending from the location where the B/W ratio detection signal was initially sampled to the transfer part, i.e. the time period between exposure and transfer Tet.

The program is designed so that at approximately the same time that data is being stored in RAM (m), as shown in FIG. 9, a data value is read in from RAM (0), based on which a transfer current-controlling voltage value is sent to a voltage circuit and transfer current is controlled. The memory to be delivered thereafter which has already been read in is then stored in RAM (0). These operations are repeated throughout image transfer. The timing of the end of the operation coincides with the arrival of the end of the paper at the transfer location, and this is recognized by the paper sensor 60 turning OFF. It is to be understood that the above-cited stepped numerical values are not limited to four stages.

The exposure-to-transfer time Tet is measured by activating a timer at the same time that exposure commences for the photosensitive body 7 charged at startup. Startup refers to the state wherein the photosensitive body 7 is charged prior to the image-producing state.

Then, a voltage is applied to the transfer charge device 8, this transfer current monitor signal is monitored, and when a change occurs in the transfer current, this indicates that the exposed portion of the photosensitive body 7 has moved to the transfer part, and the timer is stopped. The timer value at this point is used as the exposure-to-transfer time Tet, and individual irregularities in exposure-to-transfer times are automatically corrected. The same effect can be achieved even when current flows into the transfer charging device, and the transfer voltage is monitored.

Figure 10:
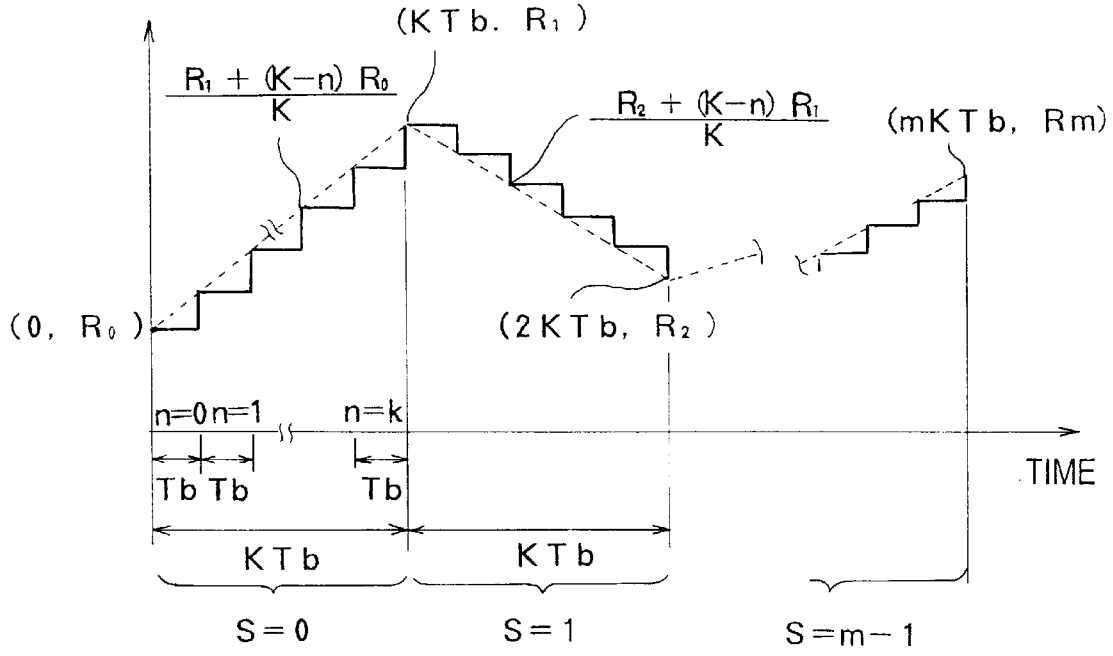
FIG. 10 is a schematic diagram of primary interpolation.

Next, a control method which utilizes primary interpolation is explained with reference to FIG. 10. If the point at which the initially sampled location reaches the transfer part is treated as 0, $$(s\times k+n)\times \mathrm{Tb} \geqq t < (s\times k+n+1)\times \mathrm{Tb}$$

provided that the transfer current control signal increases or decreases at the points t indicated as s=0–m, n=0=k by the numerical value calculated from the following expression:

$$(Rs+1+(K-n)\mathrm{Rs})/k$$

Here, Rs is the read value of memory RAM (s), and the period following s=m is treated as s=0.

This enables a 1/k savings of memory. And the values of the intermediate stages of the stored numerical values are obtained via primary interpolation, making smooth control possible.

Figure 11:
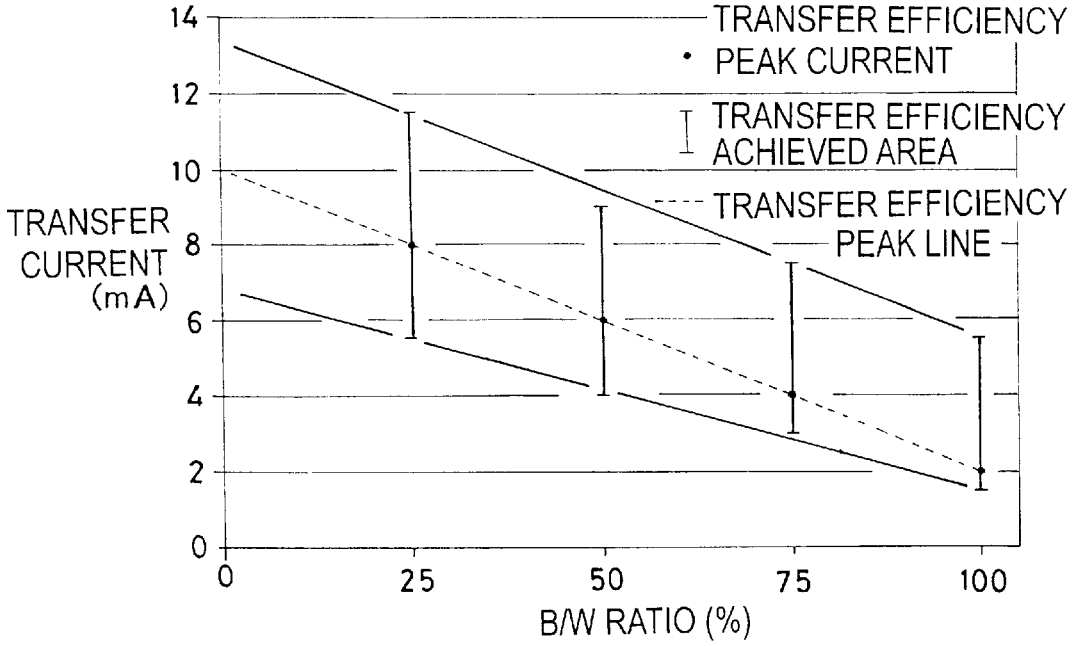
FIG. 11 is a diagram of the transfer current setting area for the B/W ratio in a laboratory black solid pattern.

Control is performed using methods such as those described above. Next, the actual current value of a controlled transfer is explained. Based on results achieved using a laser printer with a system speed of 38 mm/sec, the graph in FIG. 11 represents current values when the amount of residual toner on the photosensitive body following transfer in a laboratory environment is less than 0.1 mg/cm$^2$ for the B/W ratio of a solid black pattern, and depicts the transfer current setting area. Since a cleaner-less system is employed in this embodiment, when the amount of residual toner is over 0.1 mg/cm$^2$, the residual transfer toner cannot be adequately removed with the revolving brush of the charging device 5, and toner remains on the photosensitive body 7, giving rise to image memory resulting from the exposure gel at image exposure, and causing an imaging problem.

Figure 12:
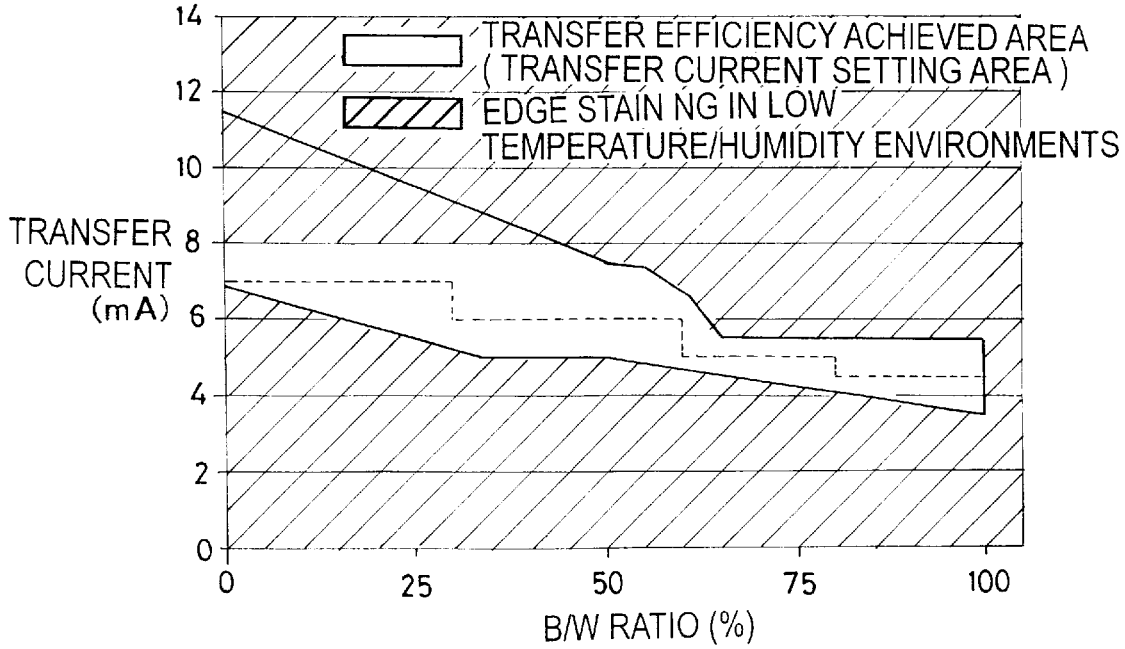
FIG. 12 is a diagram of the transfer current setting area for a B/W ratio, which includes environmental and printing patterns.

Also, such a transfer current setting area for a B/W ratio will differ by printing pattern and environment. FIG. 12 shows a transfer current setting area, which also incorporates the effects of printing pattern and environment. The part of this graph not marked with diagonal lines is the transfer current setting area, and setting the transfer current value within this area makes it possible to ensure optimum transfer efficiency by furnishing feedback on the printing pattern, printing B/W ratio and environment to transfer mechanism every 10 msec.

The optimum transfer current value for a B/W ratio is felt to be a transfer current of 7μA for a B/W ratio between 0–30%, 6μA at between 30–60%, 5μA at between 60–80%, and 4.5μA at between 80–100%.

It is also possible to achieve stable transfer efficiency and good image formation by switching the transfer current in a timely manner for each main scan in accordance with the B/W ratio within a single page.

The above-described transfer current setting value is the current value for A4, letter-size paper. And even with different size paper, if the transfer current value is changed according to the size of the paper, it is possible to achieve the same effects as that of the above-cited printer.

The above-described printer operates at a system speed of 38 mm/sec, but even if the system speed differs from this, if the setting value of the transfer current increases or decreases proportionately in accordance with the system speed, it is possible to achieve the same effects as that of the above-cited printer.

Figure 13:
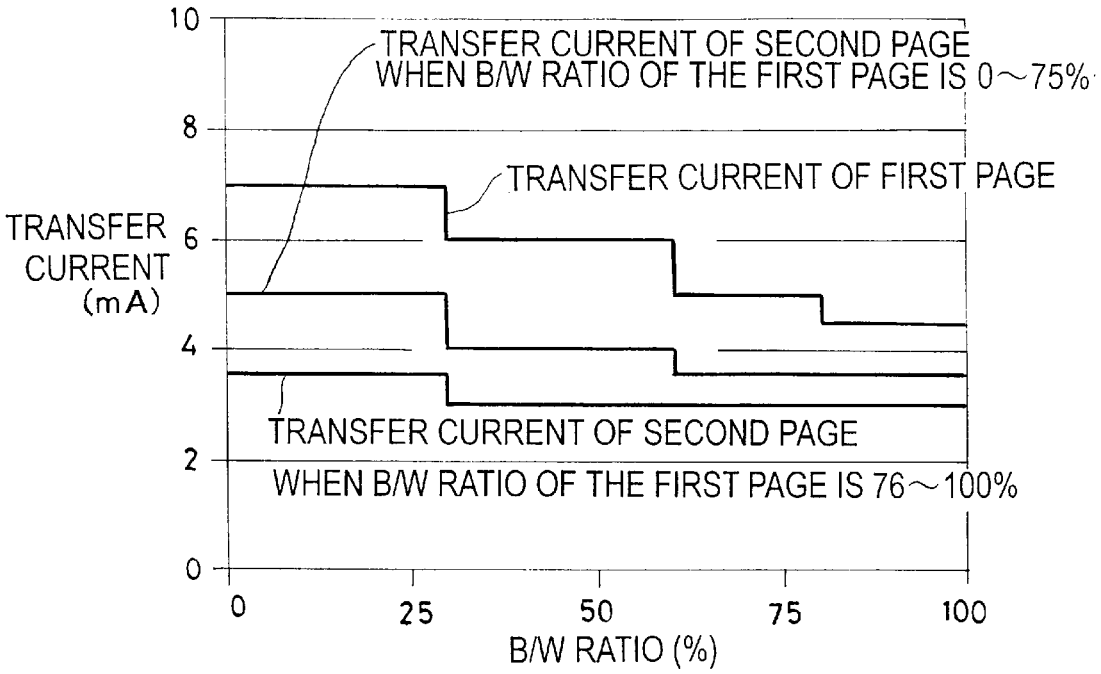
FIG. 13 is a graph showing examples of side two transfer current settings.

When printing on both sides of a paper, and for synthetic copying, the moisture in the transfer material evaporates and the resistance value rises, as the transfer material generally passes through a fixing device one time. Consequently, when the transfer output which transfers a first image is outputted at the transfer of a second image, the voltage of the transfer paper rises too high, and in low humidity environments in particular, this voltage leaks between the transfer roller and the photosensitive body, the toner may be partially charged with a reverse polarization, or the voltage of the transfer material may drop, causing white spots. For this reason, the transfer current of the second image is normally made slightly lower than the transfer current value of the first image. When the B/W ratio of the first image is high especially where the first image lies precisely on the back side of the second image or overlaps with the second image, white spots appear even more readily due to the toner layer, and the transfer output must be lowered even further when transferring the second image. FIG. 13 depicts an example of this.

Figure 14:
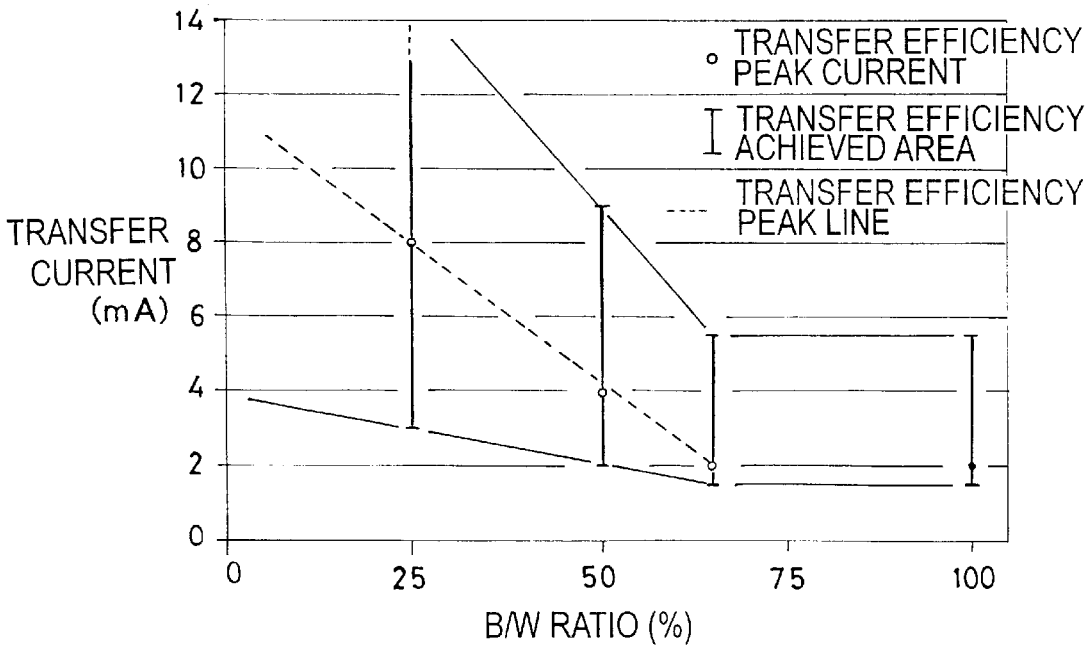
FIG. 14 is a diagram of the transfer current setting area for the B/W ratio in a laboratory halftone dot pattern.

In FIG. 12, if the B/W ratio is the same, the same transfer output is outputted whether the image is a solid image or a halftone dot image. But strictly speaking, even if the B/W ratio is the same, the optimum transfer output will differ slightly for a solid and a halftone dot. To further enhance transfer efficiency, it is better to detect whether the image is a solid or a halftone dot, and to change the transfer output accordingly for each. FIG. 14 presents the transfer current setting area for a halftone dot pattern. For example, since the ON/OFF interval and ON/OFF timing of the image signal differ for a solid black image and a halftone dot image, by detecting these differences, it is possible to determine whether an image is solid black or halftone dot. When a halftone dot is detected, the displacement is corrected so that the transfer current setting value is the same as that for a solid black image.

As for the corrected value, since the transfer current setting value when there is a halftone dot pattern with a B/W ratio of 60% is practically the same as the transfer current setting value when there is a solid black pattern with a B/W ratio of 100%, the B/W ratio of the halftone dot pattern is controlled by multiplying it by 1.67, up to a MAX of 100%.

Figure 15:
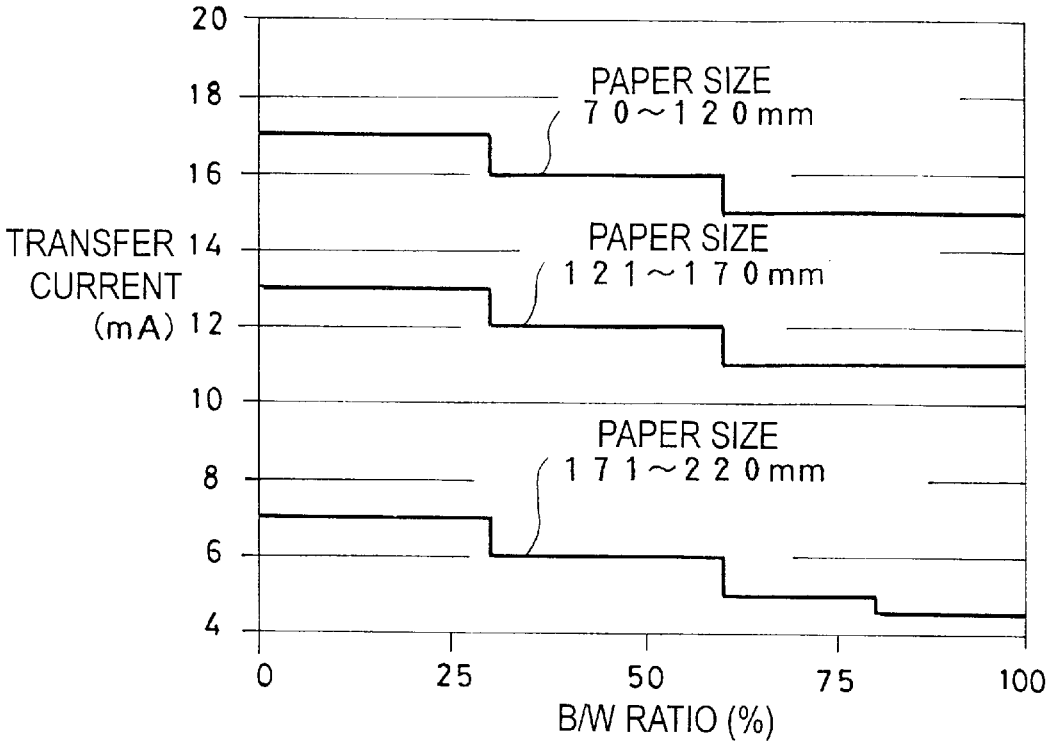
FIG. 15 is a graph showing examples of transfer current settings according to paper size.

The optimum transfer current value will differ according to paper size as well, and by switching the transfer current in accordance with the paper size, it is possible to assure optimum transfer efficiency. FIG. 15 presents an example of this.

Figure 16:
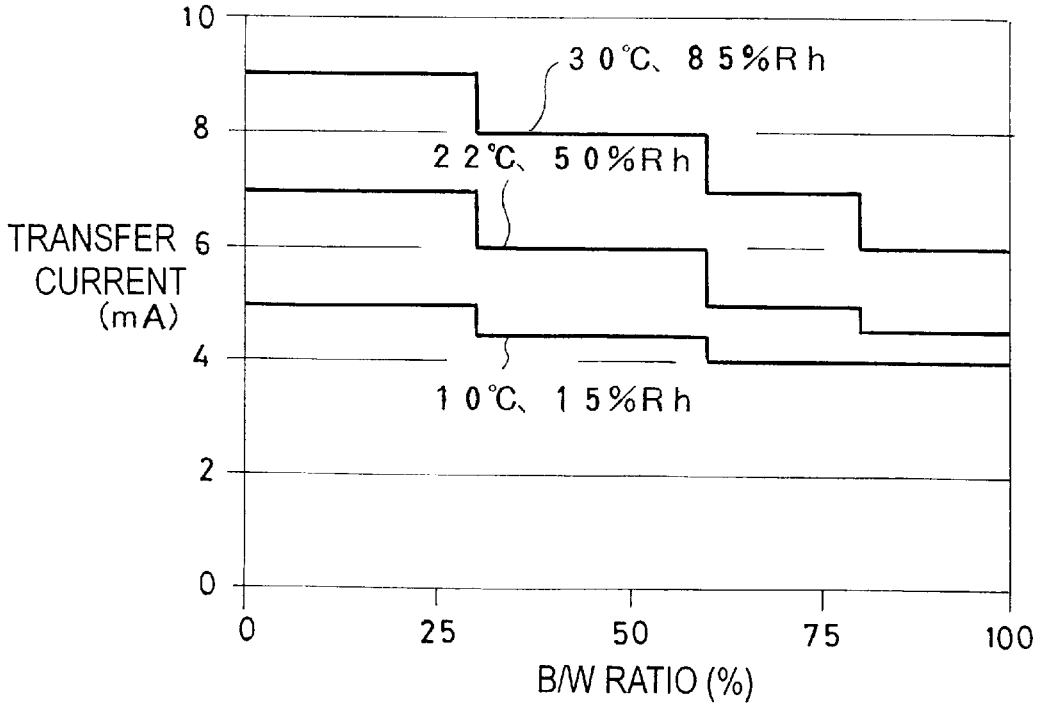
FIG. 16 is a graph showing examples of transfer current settings according to environment.

The optimum transfer current value will also differ according to the environment. Accordingly, if an environment sensor is used to detect the environment, and the transfer output is changed in accordance with that environment, it is possible to assure more stable transfer efficiency. FIG. 16 presents an example of dealing with differences in environmental temperature and humidity.

As described above, as the detection characteristic of an image signal, which is used in control that rationalizes the transfer efficiency of a transfer charging device 8 or other transfer mechanism, in addition to the above-described B/W ratio, there should be data which detects the ratio of latent images to non-latent images for various printing patterns such as solid black and halftone dot patterns. The point at which this ratio is detected, as described in this embodiment, is not limited to the point when a latent image is formed by exposing an image onto the photosensitive body 7. What is important is that the timing be matched so that transfer efficiency, at the point when a visible image related to a detected image signal is to be transferred, can be controlled based on the detected image signal relative to this visible image.

Moreover, transfer efficiency is not based solely on image signals like this, and it is also possible to form better images by controlling the transfer mechanism in accordance with the various image-producing conditions cited above. Targeting at least one of the image-producing conditions that impacts on transfer efficiency, such as the size of the transfer material 12, the type of transfer material 12, such as ordinary paper or OHP sheets, environmental conditions, number of durable pages, durable time, whether printing is done on two sides or not, and whether there are synthetic images or not, is effective.

The above-described embodiment is a laser printer, but the present invention can also be utilized in such other equipment as analog copying machines, which are capable of reading image data, digital copying machines, which use image signals to carry out transfer control, reader printers, facsimile machines, color copiers, and color printers. The inputting of image signals into these machines is not limited to the above-cited computer. Any signal capable of being inputted into an image formation device is fine, such as signals from image readers and scanners, or information processing devices other than computers, or signals inputted via telecommunications lines, or signals stored on external storage media.

In other words, the present invention can be of any configuration, so long as it forms an image by using transfer mechanism to transfer to a transfer material an image formed on an image carrier in accordance with an image signal. The present invention is not particularly concerned with the type of image-carrier, the system used to produce an image on this body, the system used to transfer to a transfer material an image carried by the image-carrier, nor the type of transfer material. Although the image carrier of this embodiment transfers to a direct transfer material a visible image formed by exposing and developing an image on a photosensitive body, the present invention is not limited to this, either, and can also be utilized in an intermediate transfer body, which is an image-carrier, to which a visible image on a photosensitive body is transferred one time, following which it transfers this image to a transfer material.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image formation device comprising:

an image carrier;

a sensor for detecting a characteristic of image signals that have been inputted for a plurality of portions of an image;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection of each of the plurality of portions of the image by the sensor of the image signals so as to control the transfer mechanism in accordance with each of the plurality of portions of the visible image that is being transferred.

2. An image formation device according to claim 1, wherein the sensor detects a black to white ratio in the image signals.

3. An image formation device according to claim 2, wherein the sensor detects the image signals per a predetermined period of time.

4. An image formation device according to claim 3, wherein the image formation mechanism forms the latent image by successively scanning in a prescribed direction, and the period of time required for the detection by the sensor is equivalent to a period of time for one scanning action of the image formation device.

5. An image formation device according to claim 1, wherein the sensor detects the image signals that is equivalent to an area where the transfer mechanism opposes to the image carrier.

6. An image formation device according to claim 5, wherein the transfer mechanism contacts the image holding member within the area where the transfer mechanism opposes to the image carrier.

7. An image formation device comprising:

an image carrier;

a sensor for detecting a characteristic of image signals that have been inputted for a plurality of portions of an image;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection of each of the plurality of portions of the image by the sensor of the image signals so as to control the transfer mechanism in accordance with each of the plurality of portions of the visible image that is being transferred as well as image producing conditions.

8. An image formation device according to claim 7, further comprising a sensor for detecting ambient conditions and a determining mechanism for setting the image producing conditions in accordance with outputs from the sensor for detecting ambient conditions.

9. An image formation device according to claim 7, wherein the image producing conditions include types of transfer member.

10. An image formation device according to claim 7, wherein the sensor detects a black to white ratio in the image signals.

11. An image formation device according to claim 10, wherein the sensor detects the image signals per a predetermined period of time.

12. An image formation device according to claim 11, wherein the image formation mechanism forms the latent image by successively scanning in a prescribed direction, and the period of time required for the detection by the sensor is equivalent to a period of time for one scanning action of the image formation device.

13. An image formation device according to claim 7, wherein the sensor detects the image signals that is equivalent to an area where the transfer mechanism opposes to the image carrier.

14. An image formation device according to claim 13, wherein the transfer mechanism contacts the image holding member within the area where the transfer mechanism opposes to the image carrier.

15. An image formation method comprising the steps of:

forming a latent image on an image carrier in accordance with image signals;

developing the latent image formed on the image carrier into a visible image;

detecting a characteristic of the image signals which are representative of the visible image for a plurality of portions of the image, and transferring said visible image onto an image holding member while controlling transfer conditions in accordance with the results of detection of each of the plurality of portions of the image, so as to control the transferring step in accordance with each of the plurality of portions of the image.

16. An image formation method according to claim 15, wherein in the step of detecting the image signals, the detection is performed per a distance corresponding to an area which is transferred.

17. An image formation device comprising:

an image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection by the sensor of the image signals being representative of the visible image that is being transferred;

wherein the sensor detects a black to white ratio in the image signals; and wherein the sensor detects the image signals per a predetermined period of time.

18. An image formation device comprising:

an image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection by the sensor of the image signals being representative of the visible image that is being transferred;

wherein the sensor detects the image signals that is equivalent to an area where the transfer mechanism opposes to the image carrier.

19. An image formation device comprising:

an image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection by the sensor of the image signals being representative of the visible image that is being transferred as well as image producing conditions;

wherein the sensor detects a black to white ratio in the image signals; and wherein the sensor detects the image signals per a predetermined period of time.

20. An image formation device comprising:

an image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection by the sensor of the image signals being representative of the visible image that is being transferred as well as image producing conditions;

wherein the sensor detects the image signals that is equivalent to an area where the transfer mechanism opposes to the image carrier.

21. An image formation method comprising the steps of:

forming a latent image on an image carrier in accordance with image signals;

developing the latent image formed on the image carrier into a visible image;

detecting the image signals which are representative of the visible image, and transferring said visible image onto an image holding member while controlling transfer conditions in accordance with the results of detection;

wherein in the step of detecting the image signals, the detection is performed per a distance corresponding to an area which is transferred.

22. An image formation device comprising:

an image carrier;

means for exposing the image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member in a transfer operation; and a controller for controlling the transfer mechanism for transferring the visible image onto the image holding member in accordance with results of detection initiated after a start of the exposing means by the sensor of the image signals being representative of the visible image that is being transferred.

23. An image formation device according to claim 22, wherein the detection used to control the transfer mechanism is initiated only after the start of the exposing means.

24. An image formation device according to claim 22, wherein the detection used to control the transfer mechanism is initiated before a start of the transfer mechanism.

25. An image formation device comprising:

an image carrier;

means for exposing the image carrier;

a sensor for detecting image signals that have been inputted;

an image formation mechanism for forming a latent image on the image carrier in accordance with the image signals;

a developing mechanism for developing the latent image formed on the image carrier into a visible image;

a transfer mechanism for transferring the visible image onto an image holding member; and a controller for controlling the transfer mechanism for transferring the visible image onto the image holding member in accordance with results of detection initiated after a start of the exposing means by the sensor of the image signals being representative of the visible image that is being transferred as well as image producing conditions.

26. An image formation method comprising the steps of:

forming a latent image on an image carrier by exposing the image carrier in accordance with image signals;

developing the latent image formed on the image carrier into a visible image;

after initiation of said exposing, detecting the image signals which are representative of the visible image, and transferring said visible image onto an image holding member while controlling transfer conditions in accordance with the results of detection.

* * * * *